United States Patent [19]

Anderson et al.

[11] Patent Number: 4,823,953

[45] Date of Patent: Apr. 25, 1989

[54] TAPE CARTRIDGE FOR A LETTERING SYSTEM

[75] Inventors: J. Becher Anderson, Hermosa Beach; Jacob de Gelder, Rancho Palos Verdes, both of Calif.

[73] Assignee: Leteron Mfg. Co., Torrance, Calif.

[21] Appl. No.: 895,744

[22] Filed: Aug. 12, 1986

[51] Int. Cl.[4] ..... B65D 85/671

[52] U.S. Cl. ..... 206/408; 206/409; 226/129; 400/613

[58] Field of Search ..... 206/389, 390, 397; 403, 206/407–409, 411; 225/45–47, 51, 52, 54; 226/118, 129, 143; 242/55.53, 71.1, 75.1, 75.2, 75, 197; 400/608.3, 613, 134.5

[56] References Cited

U.S. PATENT DOCUMENTS

| | | | |
|---|---|---|---|
| 2,873,927 | 2/1959 | McDonald | 242/55.53 |
| 2,951,623 | 9/1960 | Haley | 225/54 |
| 3,036,751 | 5/1962 | Bartschi | 225/54 |
| 3,505,153 | 4/1970 | Addis | 225/54 |
| 3,895,059 | 7/1975 | Link | 225/54 |
| 3,941,289 | 3/1976 | Jenkins | 226/129 |
| 4,053,094 | 10/1977 | Males | 206/409 |
| 4,239,399 | 12/1980 | Johnstun | 400/613 |

*Primary Examiner*—Jimmy G. Foster
*Attorney, Agent, or Firm*—Christie, Parker & Hale

[57] ABSTRACT

A cartridge for dispensing tape to be lettered in a first direction out of the cartridge includes a cartridge frame. The cartridge frame supports the tape and guides the tape. The cartridge includes posts fixed to the frame for supporting a roll of tape and for contacting an interior surface of a roll of tape. The cartridge frame further includes a tape guide. A tape bias mechanism such as a spring and pad is mounted in the cartridge frame for biasing the tape in a second direction substantially opposite the first direction.

19 Claims, 9 Drawing Sheets

Fig. 7A WALT +3 (0.225)

Fig. 7B WALT +2 (0.135)

Fig. 7C WALT +1 (0.070)

Fig. 7D WALT STANDARD 0 (0.005)

Fig. E WALT -1 (-0.060)

Fig. 7F WALT -2 (-0.125)

TAPE CARTRIDGE FOR A LETTERING SYSTEM

CROSS-REFERENCE TO RELATED APPLICATIONS

This application is co-pending with an application entitled APPARATUS FOR CUTTING INDICIA FROM TAPE, Ser. No. 211,133, filed June 22, 1988, which is a continuation of Ser. No. 895,832, filed Aug. 12, 1986, and now abandoned the specification of which is incorporated by reference.

BACKGROUND OF THE INVENTION

1. Field of the Invention

This invention relates to devices for holding or dispensing tape used in machines for cutting indicia from the tape.

2. Description of Related Art

U.S. Pat. Nos. 3,490,362, 3,558,425 and 3,673,953 are predecessor patents relating to apparatus and tape for cutting indicia from tape. Specifically, the '425 patent describes a three layer laminated tape useful in the present invention from which indicia may be cut. The tape is such that tension should be maintained over a length of the tape being cut in order for proper cutting to occur. Additionally, steps should be taken to minimize the possibility that the tape will unravel since the layers of three different materials would expand at different rates and cause wrinkling.

In previous machines for cutting indicia from tape, the tape was wrapped on a cardboard ring or core and fixed to a spool. The spool included slip clutches inside the spool to produce drag in the tape for proper tensioning while cutting the indicia. The contact between the cardboard ring and the spool prevented unraveling of the tape.

Melhman et al., U.S. Pat. No. 2,105,948 shows a sales tax check machine with a spool of sales tax tickets to be fed through a cancellation mechanism. The roll is supported on a core and revolves on a spindle extending between side walls. Cook, U.S. Pat. No. 1,726,611 is similar.

SUMMARY OF THE INVENTION

A cartridge dispenses tape, wherein the tape is made in such a way that indicia may be cut therefrom. The cartridge dispenses the tape in a first direction out of the cartridge. The cartridge includes a cartridge frame for supporting the tape. In a first embodiment, the cartridge frame comprises means fixed to the frame for supporting a roll of tape, for frictionally contacting an interior surface of a roll of tape, and for allowing the roll to slip when the tape is pulled with a sufficient force. A tape guide guides the tape as it is being pulled from the frame. Means are also provided for frictionally engaging the tape to create a drag on the tape when it is pulled from the cartridge. The roll supporting means and the tape engaging means combine to prevent the roll from unraveling.

In a second embodiment, the cartridge includes means mounted in the cartridge frame for biasing the tape in a second direction substantially opposite the first so that the tape is pulled back a given distance after dispensing.

In a third embodiment, the cartridge includes guide means for guiding and supporting a die plate by means of which indicia are cut from the tape. This provides an efficient combination of dispenser and die plate guide, and also provides a disposable die plate guide. The tape supply in the dispenser will be depleted before any significant wear occurs on the die plate guides.

The cartridge design allows for easy removal and replacement of a particular type of tape in the lettering machine. For example, after a sign is created on one color of tape, a different sign may be created on a second colored tape merely by removing the first cartridge and inserting a second. Since lettering tape of the type described in the prior patents is subject to unraveling and wrinkling of the individual layers, the present design inhibits such unraveling. The present design also allows for negative kerning, when used in conjunction with an indicia-forming machine, so that adjacent characters may be placed closer together than was originally possible. This allows for spacing between characters that appears to the human eye to be more uniform for a given word and is more aesthetically pleasing.

BRIEF DESCRIPTION OF THE DRAWINGS

In the Drawings:

FIG. 4A is a perspective view of an embodiment of an upper guide post according to the invention;

FIG. 4B is a similar view of a lower guide post;

FIGS. 7A–7F show possible spacings between letters of words formed using the lettering machine in conjunction with pullback of the lettering tape after formation of each letter;

DETAILED DESCRIPTION OF THE PREFERRED EMBODIMENT

Figure 1:
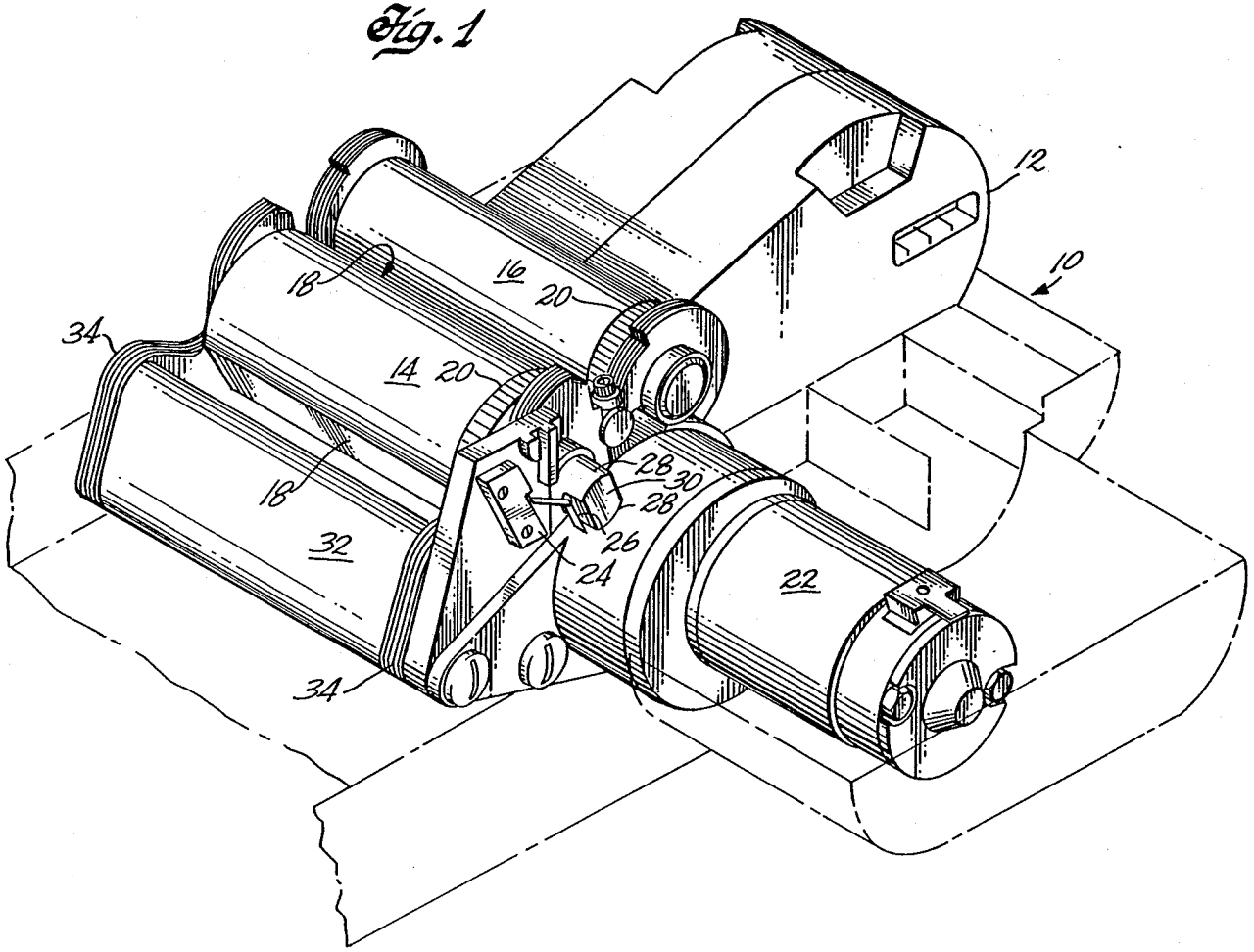
FIG. 1 is a schematic and perspective view of a lettering machine for forming letters in letter tape.

FIG. 1 shows an apparatus for cutting indicia in tape in the form of a lettering machine 10 for lettering tape (not shown in FIG. 1) fed from a tape dispensing cartridge 12 for making signs, labels, etc. It is to be understood that the lettering machine does not form only letters but may form any type of character or figure in the tape limited only by the size of the tape and the design on the die plate, described more fully below. However, "lettering machine" is a convenient designation. The details of the lettering machine are described in applicant's co-pending application, Ser. No. 895,832 filed Aug. 12, 1986. The more salient features of the lettering machine will also be described herein.

A large flatted pressure roller 14 and a small pressure roller 16 are mounted in the lettering machine 10 for pressing a die plate and lettering tape together between the pair of rollers to form a character such as a letter in the lettering tape 14. Though any character or figure may be formed in the tape, it will be assumed hereafter that letters are the particular types of characters to be formed in the tape The flats 18 of the large pressure roller are located on diametrically opposite sides of the large pressure roller. Each flat provides a larger space between the pressure rollers when each flat is located opposite the small pressure roller than occurs when an arcuate portion of the large pressure roller is opposite the small roller. The pressure rollers are rotated by gears 20 driven by a pinion gear (not shown) coupled to the motor 22 such that one of the flats of the large pressure roller is positioned immediately opposite the small pressure roller at the end of each cycle. A cycle consists of one half rotation of the large pressure roller, or 180°. Control of the motor is provided through a microswitch 24 having a bearing surface 26 for contacting surfaces 28 of the axle 30. The rollers and motor are supported on a base 32 through side plates 34.

Figure 2:
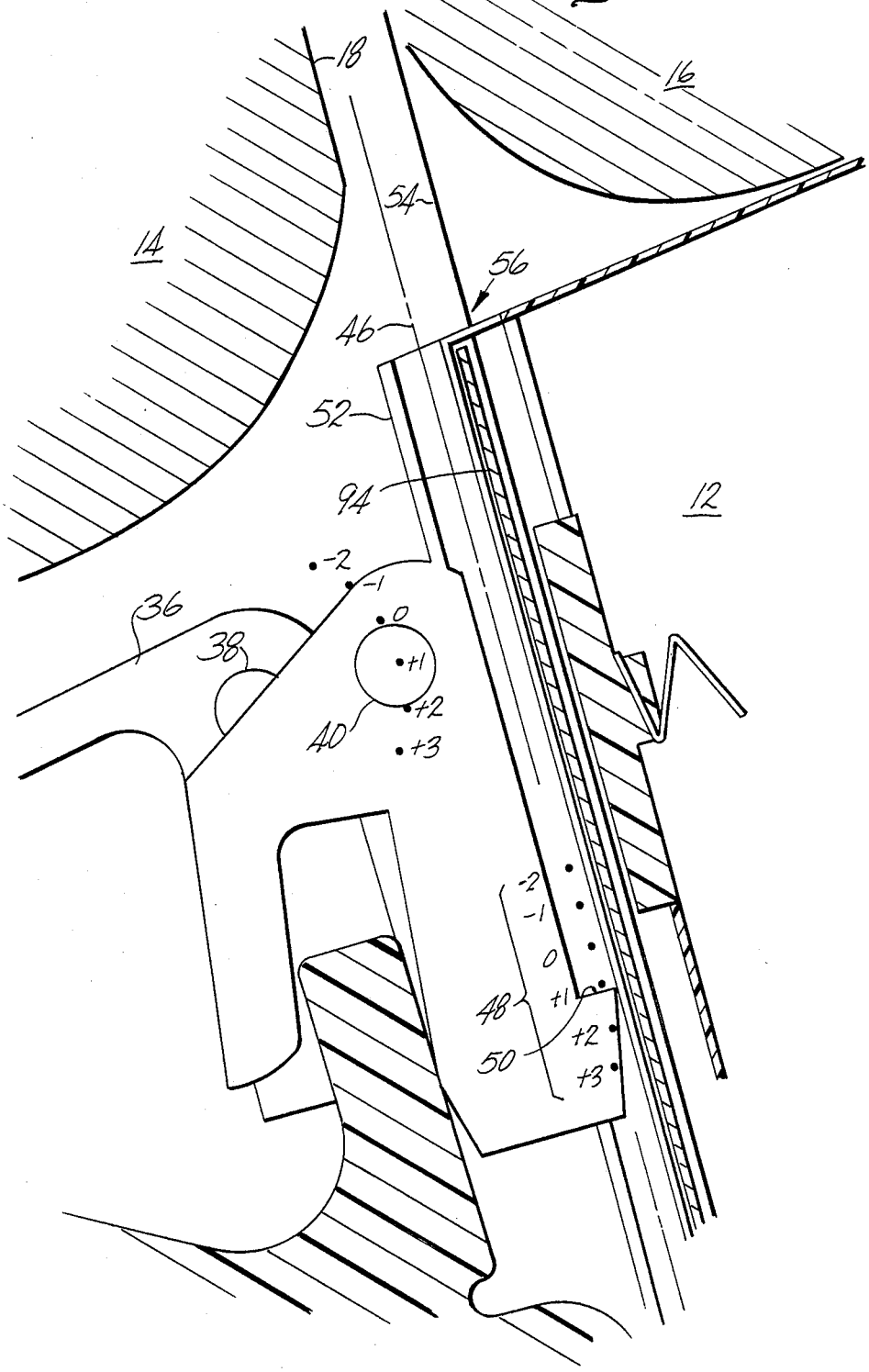
FIG. 2 is a schematic and side elevation view of a portion of the lettering machine of FIG. 1 and including a portion of a lettering tape cartridge.

FIG. 2 shows a partial cross-sectional view of the lettering machine of FIG. 1. The rollers 14 and 16 shown in FIG. 2 are not to scale and serve only to schematically indicate the rollers relative to the remaining apparatus. The base 32 supports a shaft (not shown) through a fixed shaft support 36 wherein the shaft extends through a shaft opening 38 in the shaft support. The end of the shaft extends into a second shaft opening 40 in a kerning adjuster 42. The shaft rotates in the opening 38 so that movement of the end of the shaft extending through the second opening 40 adjusts the position of the kerning adjuster. Positioning the shaft end at one of the points 44 positions a die plate (not shown) at respective positions along an axis 46, which positions are defined by the points 48 corresponding to the points 44. A ledge 50 is provided on the kerning adjuster for supporting the die plate along the axis. In one embodiment, the cartridge, to be described more fully below, includes die guides 52 for supporting and guiding the die plate with respect to the rollers 14 and 16 during formation of the letters on the lettering tape.

Die guides on previous machines were incorporated into the structure of the machine and were made from a strong material capable of withstanding significant wear caused by motion of the die plate in the die guide. However, in the preferred embodiment, the die guides are formed in the tape dispensing cartridge and do not experience significant wear before the tape in the cartridge is used up.

Lettering tape 54 is supplied from the cartridge from a tape guide in the form of dispenser slot 56 at the end of the cartridge adjacent the rollers. The tape passes upwardly between rollers 14 and 16 to be pressed between the rollers with a die plate and then out the top of the lettering machine. Therefore, this embodiment of the present invention includes a tape cartridge for dispensing tape having die guides for supporting and guiding die plates for use in forming letters on the tape.

Figure 3:
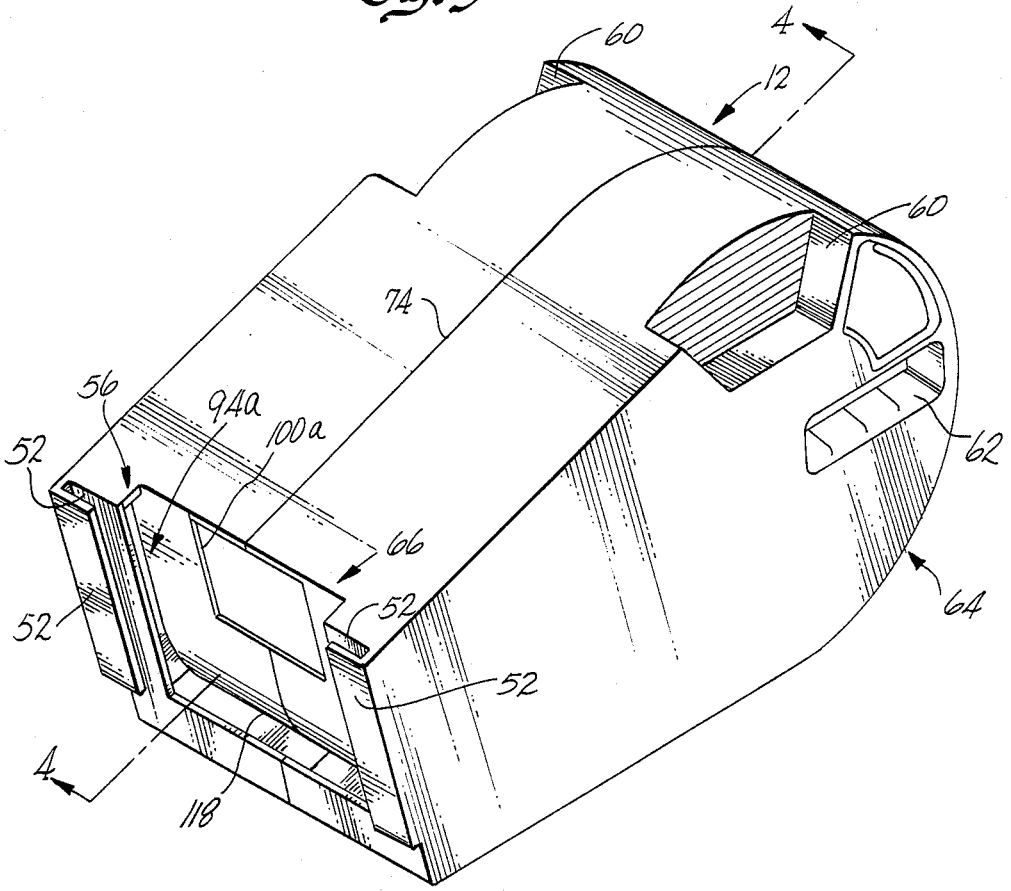
FIG. 3 is a schematic and perspective view of an empty tape cartridge according to the present invention.

FIG. 3 shows the dispensing cartridge Identical elements as those of FIG. 2 are identically numbered. Additionally, FIG. 3 shows grip pockets 60 and a tape length indicator 62 at a tape end 64 of the cartridge opposite the guide and 66.

Figure 4:
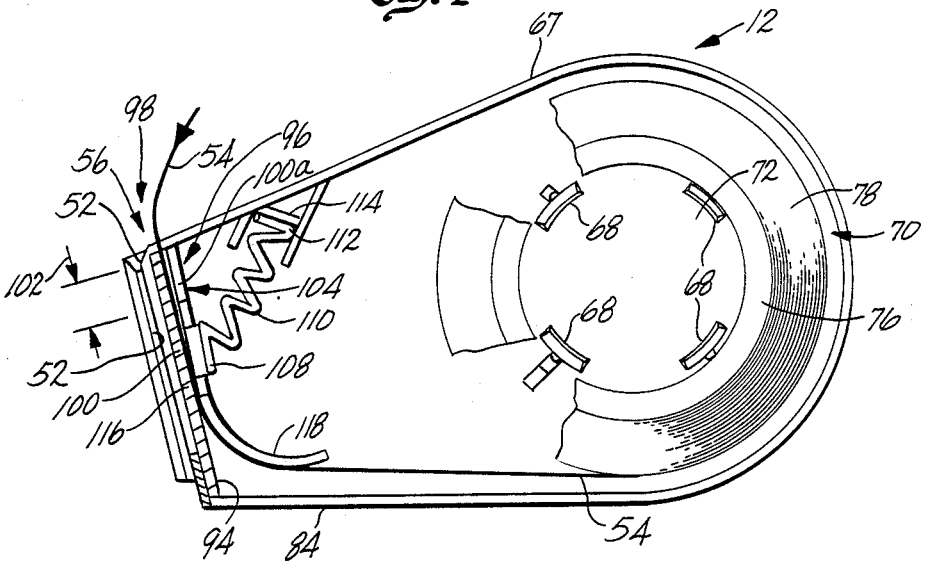
FIG. 4 is a schematic and side section of the tape dispenser of FIG. 3 embodying the present invention.
Figure 5:
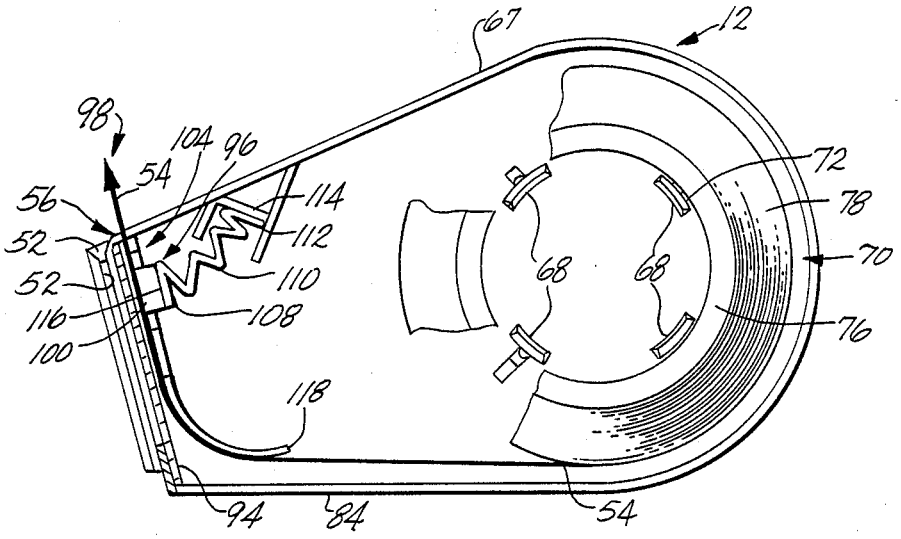
FIG. 5 is a schematic and side section of a tape dispenser similar to that of FIG. 4 showing repositioning of means for biasing the tape.

A further embodiment of the invention is shown in FIGS. 4 and 5. The cartridge includes a cartridge frame 67 for supporting the tape and for guiding the tape. Preferably, the frame substantially encloses the tape and is made from a durable plastic such as high impact styrene. The frame could also be a skeleton frame having a minimum of structure so that the tape is exposed. The term "cartridge" as used herein may include any means for dispensing tape combined with any one or more of the characteristics described herein, including tape pull back, friction means to inhibit unraveling of the tape or friction means to provide sufficient tension in the taps for suitable letter-forming of the desired quality.

Four roll guide stands 68 are fixed to the frame for supporting a roll 70 of tape. The guide stands are preferably made of the same material as the frame. The guide stands may be bonded to the inside surface of one side 72 of the frame and extend inwardly toward a central plane defined by the junction 74 of two halves of the cartridge shown in FIG. 3. The guide stands, shown in FIGS. 4, 4A, and 4B, are designed so that the guide stands frictionally engage the core of the roll of lettering tape for producing a drag force. The drag force acts against a force on the end of the tape, pulling the tape from the cartridge. The frictional engagement, along with the tape bias described more fully below, requires a minimum force, for example, 3 pounds, necessary to withdraw the tape from the cartridge. In one embodiment, each of the guide stands includes an arcuate-portion conforming to the curvature of the core of the lettering tape and a rounded ridge extending along the top center of the arcuate portion from a chamfered end of the arcuate portion to a flanged portion. The flanged portion extends higher than the ridge from the top center of the arcuate portion and includes a slanted front face at an angle of approximately 45° with respect to the rounded ridge against which the edge of the core is placed. As shown in FIG. 4B, the flanged portion of the lower two guide stands is higher than the corresponding flanged portion on the upper two guide stands 68A. The flanged portions on the lower two guide stands also serve to position and center the lettering tape as the cartridge is being assembled. Other arrangements can be made for the guide stands for frictionally engaging the core and lettering tape.

The guide stands in a further embodiment not shown in the FIGURES conform to the circular inside surface of the roll of tape. The guide stands include an end facing outwardly toward the middle of the tape roll which is beveled to provide a surface diverging away from the inside surface of the tape roll. The beveled surface facilitates mounting of the roll on the four guide stands.

It should be understood that four roll guide stands are also fixed to the second side of the cartridge opposite the first side 72 for supporting the roll of tape. The roll of tape includes a cardboard core 76 and multiple layers 78 of tape. The tape may be tape such as that described in U.S. Pat. No. 3,558,425. The core is placed about the four guide stands on each side of the frame so that the guide stands contact the interior surface of the cardboard core. The guide stands are formed so that the frictional engagement of the guide stands with the cardboard core prevent rotation of the roll with respect to the frame absent a significant pulling force on the end of the tape 54. In the preferred embodiment, three pounds of force is adequate to pull the tape from the cartridge, thereby overcoming the stationary frictional force of the guide stands and of the pad, described below. The guide stands also contribute to maintaining the proper tension in the tape while letters are being formed. Proper tape tension enhances precise cutting Therefore, the cartridge may be comprised of a tape dispenser having frictional engagement between the roll of tape and a portion of the cartridge to limit tape unraveling and to contribute to tension in the tape for improved letter forming.

Figure 9:
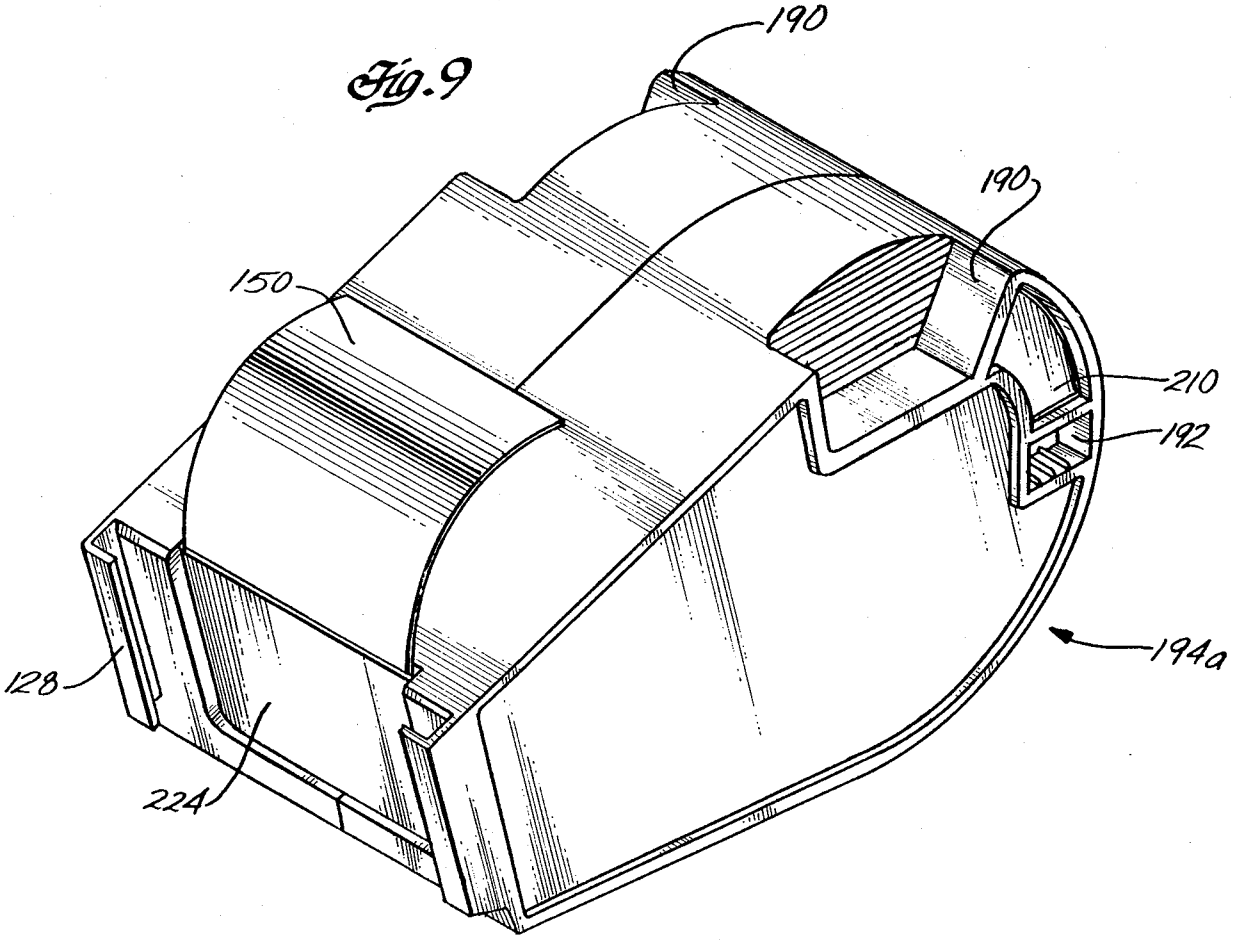
FIGS. 9–11 show a further embodiment of the tape cartridge of FIG. 3.
Figure 10:
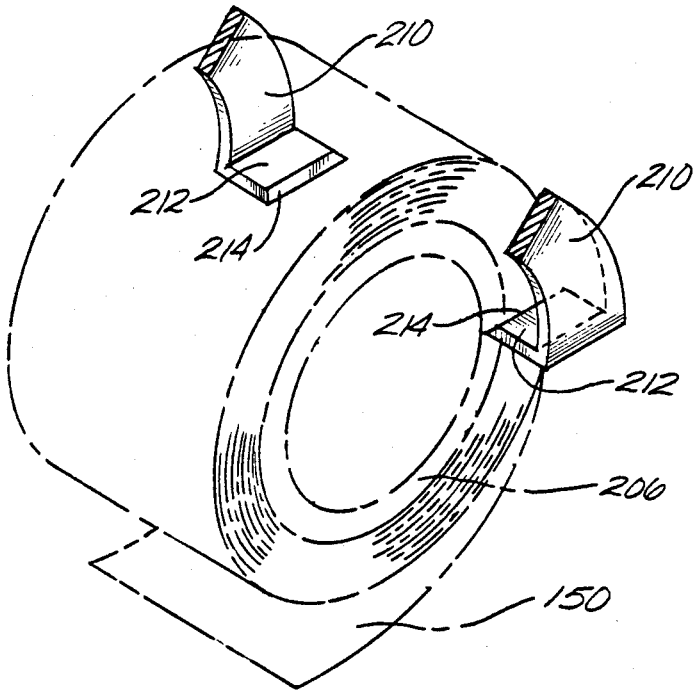
Figure 11:
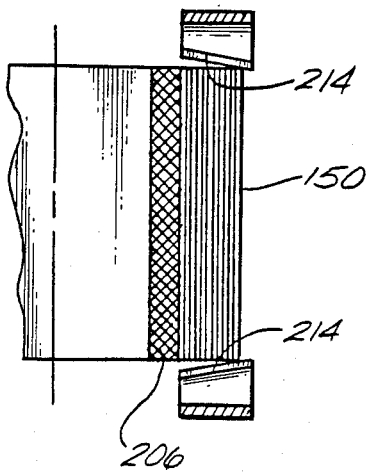

In a preferred embodiment, a frictional engagement mechanism in the form of pressure tabs 210 are formed on each side of the cartridge between the grips 190 and the tape length indicator 192, as shown in FIGS. 9–11. The pressure tabs are formed during the injection-molding process in each half of the tape cartridge to be biased inward when a tape roll is in place. Each pressure tab extends from the adjacent wall of the grip pocket arcuately along the side of the ape cartridge toward the tape length indicator. Each of the pressure tabs is preferably molded 10° inward relative to the side of the tape cartridge.

FIG. 10 shows each of the pressure tabs without each half of the tape cartridge with which they are integral. The roll of lettering tape is shown in phantom. FIG. 10 shows a flanged portion 212 for each pressure tab extending inwardly from the arcuate portion of the pressure tab to a beveled end 214 for contacting the respective edges of the lettering tape for producing a drag force on the tape roll to prevent the tape from unraveling. The pressure tabs also produce a drag force for increasing the force required to withdraw the tape from the tape cartridge.

As shown in FIG. 11, the entire length of the beveled edges does not contact respective sides of the tape roll. Each of the flanged portions 212 are trapezoidal in plan view and have a beveled edge nonparallel to the junction of the flanged portion and the arcuate portion As a result, the pressure tab contacts the tape at a limited portion of the beveled edge so that the frictional engagement of the pressure tab with the lettering tape is localized. As the number of layers of lettering tape on the roll decreases, the pressure tabs move toward one another and contact the lettering tape at different locations on the beveled edges.

If the pressure tabs are omitted from the tape cartridge, significant unwinding of the lettering tape from the core does not occur, even when the tape is pulled back into the cartridge, as described more fully below. These embodiments of the tape cartridge comprise a tape dispenser and friction engagement means for frictionally engaging the tape to inhibit unraveling and to assist in providing proper tape tension.

The tape extends from the tape roll to the dispenser slot 56 as shown in FIGS. 3, 4 and 5 of the drawings. The tape is passed along a steel plate 94 mounted in the opening 94*a* (shown in FIG. 3) of the frame. The steel plate provides a rigid, smooth backing against which the tape is forced by pad 100, described below. The tape is passed between the steel plate and the tape bias 96 mounted in the cartridge frame for biasing the tape in a second direction, indicated by arrow 98 opposite the direction in which the tape is pulled from the cartridge. The tape bias includes a disc-shaped pad 100 having a diameter of 0.630 inch extending substantially the minimum width of the pad opening 100*a* (FIG. 3). The pad opening is preferably trapezoidal with the top and bottom edges parallel and the side edges each extending outward from top to bottom 4° from the vertical. This shape allows the pad to slide freely in the opening and minimizes the possibility of one part of the pad applying a larger force than another part of the pad. In other words, this shape minimizes rotation of the pad as it moves in the opening. The pad is formed from any friction type material such as santoprene, neoprene, rubber, polyvinylchloride, etc., such that the surface contacting the tape produces a frictional force preventing movement of the tape in either direction for a given force on the tape when the pad is stationary. The pad is able to move in a direction parallel to arrow 98 a distance 102 of preferably 0.225 inch. The pad is movable within a race 104 defined by the steel plate 94 and by pad opening 100*a*.

The pad includes a mounting surface 108. The tape bias further includes a coil spring 110 mounted at a first end 112 to the top of the frame through a spring mounting pad 114. The first spring end is preferably mounted to the frame at least as high as the uppermost extent of travel of the pad in the race, as seen in FIG. 4. The second end of the spring 116 is coupled to the mounting surface 108 of pad 100.

The spring 110 preferably has a coil, each coil having an outside diameter of 0.375 inch. The coil is made from 0.030 inch diameter spring steel wire which has been single plated. The uncompressed length of the spring is preferably 1⅛ inches.

The tape bias frictionally engages the tape between the pad and the steel plate 94. When a force of approximately three pounds is applied to the end of the tape to pull the tape from the cartridge, the tape and pad travel through the race 104 until the pad reaches the uppermost extent of the race, adjacent the top of the frame. The tape is continually pulled from the cartridge when the force is being applied to the tape, for example, through rotation of the pressure rollers. When the force is removed from the end of the tape, the frictional engagement between the pad and tape and the spring bias produced by the coil 110 causes part of the tape to return into the cartridge. The pad moves downwardly along the race until it reaches the lowermost point of the race. In the preferred embodiment, the tape is pulled back a distance of 0.225 inch. However, this distance depends on the particular design of the machine, including the kerning adjuster Therefore, a further embodiment of the tape cartridge comprises a tape dispenser and a tape pullback into the cartridge a given distance.

An arcuate tape bearing surface 118 extends below the race downward and rearward toward the wall 84, the tape baffle 80 and the tape roll. The bearing surface preferably extends the width of the lettering tape. The surface 118 guides the tape from the wall 84 to the steel plate 94 and beneath the pad 100 and provides an arcuate path for smoothing the turn of the tape toward the dispenser slot 56.

FIG. 5 shows the tape cartridge of FIG. 4 wherein the tape is under tension of a three pound force and wherein the pad is at the uppermost extent of travel in the race. As depicted in FIG. 5, the tape is under tension throughout the cartridge The four guide stands and the tape baffle provide a counterforce against the force of pulling of the tape to keep the tape taut. The pad also provides a frictional force so that removal of the tape from the cartridge is relatively uniform. The pad, and generally the tape bias, serves two functions The first function is to provide tape pull-back of a predetermined amount and the second is to limit return of the tape into the cartridge to the predetermined amount. The tape bias also serves to assist in frictionally engaging the tape to inhibit unraveling and to provide proper tensioning for letter forming. The pad and the guide stands each contribute to drag on the tape, much like stack rollers in assembly lines.

Figure 6:
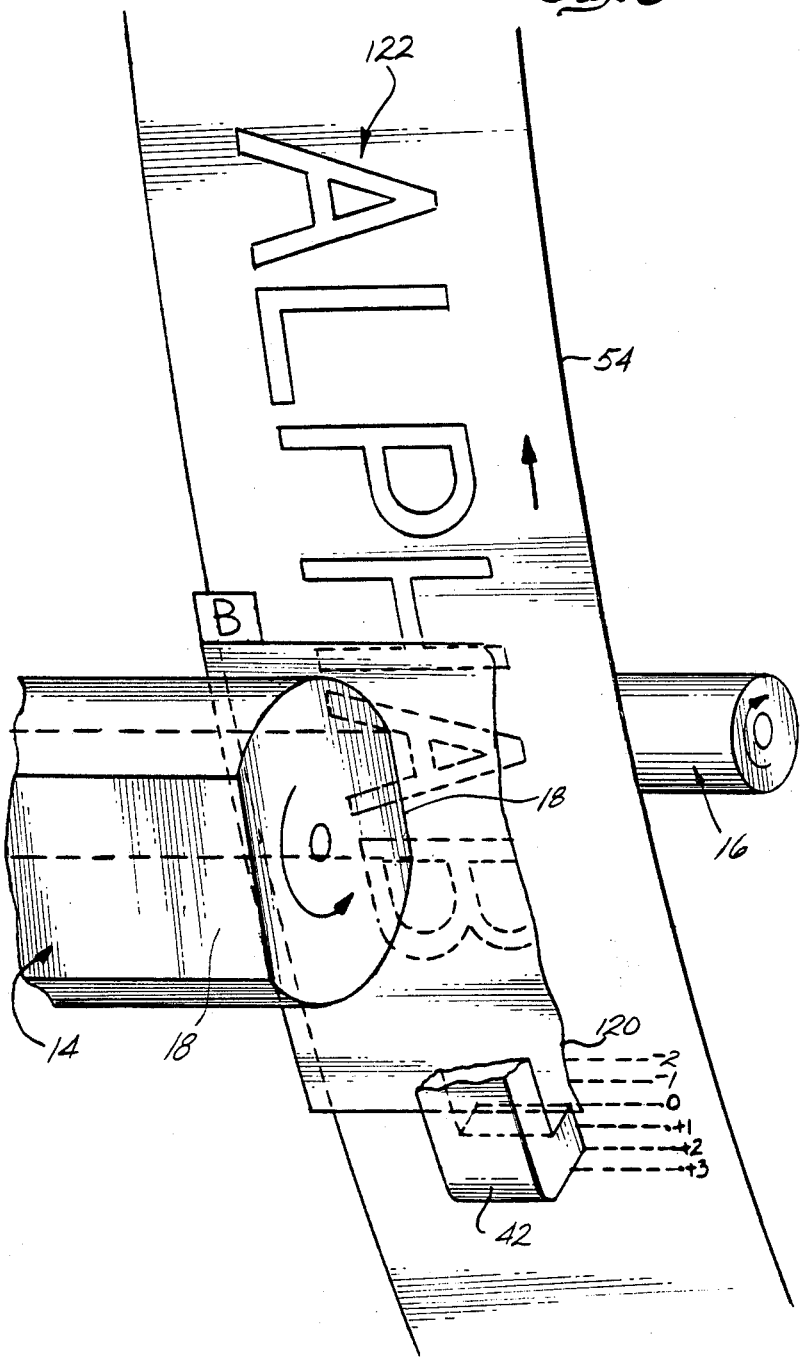
FIG. 6 is a schematic and perspective view of a portion of the lettering machine and lettering tape.

The tape 54 is shown in FIG. 6 between the pressure rollers 14 and 16 along with a die plate 120 for forming a letter in the lettering tape. In FIG. 6, a series of letters 122 have already been formed on the lettering tape. The next letter to be formed is the letter "B", as indicated by the die plate. The letter is formed in the lettering tape through pressure applied between the pressure rollers and through rotational motion of the pressure rollers as indicated. As the rollers turn, the die plate and tape are taken up by the pressure applied by the rollers and are passed between the rollers.

Figure 8:
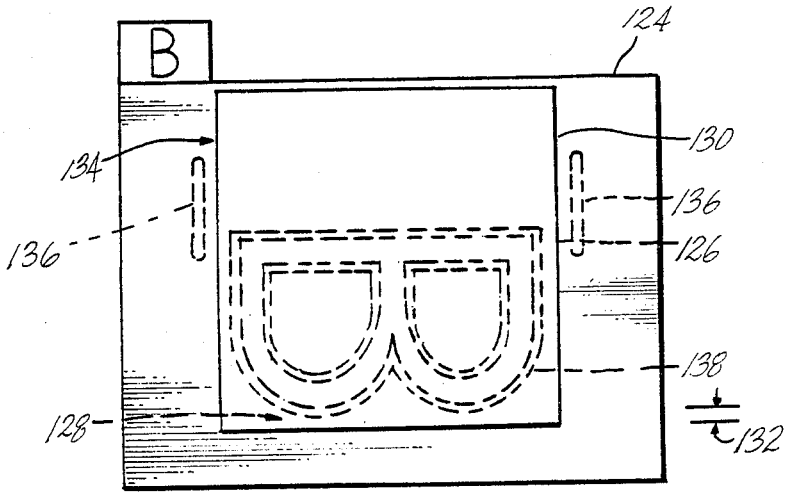
FIG. 8 shows a front elevation view of a die plate for use with the present invention.

A die plate 124 is shown in more detail in FIG. 8. FIG. 8 shows a front view of the die plate. Each letter is formed on its die plate so that the leading edge 126 of the letter is always a given distance from the bottom of the die plate. The position of the trailing edge 128 will depend on the width of the letter. In the preferred embodiment, a label 130 is placed on the front of the die plate 124 for facilitating take-up of the die plate and lettering tape as the flatted pressure roller and small pressure roller advance. The thickness of the label is chosen as a function of the separation distance between the two rollers during operation, the lettering tape thickness and the thickness of the die plate 124 over which the label is placed. The separation between the rollers during operation is taken to be the distance between the roller surfaces when one of the arcuate surfaces of the flatted roller is immediately opposite the small pressure roller. Since the lettering tape is usually of a known thickness, within certain tolerances, and the die plate is of a known thickness within certain tolerances, the label is also designed with a certain thickness so that the pressure from both sides due to the two pressure rollers creates a frictional force for pulling the die plate and tape together between the rollers. The label adds a predetermined thickness to the material between the rollers to allow the pulling. The thickness of the label is such that the die plate and tape advance only when the label is in the separation between the rollers.

The vertical height, as seen in FIG. 8, of the label 130 is selected according to the size and position of the particular letter formed in the die plate. For example, the label used on a die plate for a "V" may be larger than the label for a "W" of the same letter type. More specifically, the height of the label depends on the distance from the leading edge to the trailing edge of the letter. However, this is fixed for each letter. The post space 132 for all letters is also fixed and is preferably 0.060 inch. The post space is the distance from the trailing edge 128 of the letter to the bottom or end of the label. The end of one label is the point where the pressure rollers no longer grip the die plates and tape sufficiently to advance them. The top of the label extends a predetermined distance above the leading edge of the letter and also extends at least as high as the drive lugs 136. The top of the label is used, along with the position of the kerning adjuster, to provide the desired prespace 134. The amount of prespace produced on the tape will vary according to the position of the die plate relative to the rollers.

The width of the label is selected to extend a sufficient distance to allow the pressure rollers to frictionally grip the die plate and lettering tape for pulling them together between the rollers. In the preferred embodiment, the label extends substantially to each of a pair of drive lugs 136 formed in the die plate for allowing the pressure rollers to frictionally grip the die plate and lettering tape together during the operation of the rollers.

The drive lugs shown in FIG. 8 are dashed to indicate that the lugs are formed in the die plate and extend into the paper of FIG. 8. The drive lugs generally serve the same function as the label 130 and make contact with the tape. The rollers grip the die plate and tape through the drive lugs to move the die plate and tape upward during operation of the rollers.

A letter 138 is formed in a die plate during its manufacture by pressing the die plate so that the letter is raised from the surface of the die plate. The raised portion forming the letter contacts the lettering tape and forms the letter therein, as described in the prior patents. The height of the letter from the surface of the die plate is determined according to the height needed for the rollers to press and grip the die plate and lettering tape for o pulling the die plate and tape between the rollers while still forming the letter as desired. The raised portion defining the letter assists in gripping the lettering tape between the rollers while forming the letter at the same time. The die plate is preferably formed from a material such as a metal sufficiently strong to maintain its shape during the letter forming process.

As discussed in the co-pending application, the letter forming ridges form the letter in the lettering tape as the ridges pass the point between the rollers where the gap between the rollers is smallest and the pressure between the rollers is the highest. When the label on the die plate passes the gap, the die plate and tape are no longer gripped sufficiently by the rollers to move them. As the rollers continue rotating, a flat is eventually presented adjacent the small pressure roller so that the gap between the pressure rollers is effectively increased. As a result, the die plate falls back to the kerning adjuster 42 or is removed by the user. The die plate is guided by the guides 52 in the cartridge. Additionally, the tape is pulled back into the cartridge an amount determined by the difference between the longitudinal dimension of the pad and the longitudinal dimension of the race. The frictional engagement between the surface of the pad and the tape limits the return of the tape into the cartridge.

Considering FIG. 6 and the relative position of the kerning adjuster, the standard position of the kerning adjuster identified by the numeral "0" provides for standard spacing of adjacent letters. In other words, the kerning adjuster is designed relative to the pressure rollers so that the die plate produces the proper interletter spacing after the letter is formed by the die plate. The interletter spacing, discussed below with respect to FIG. 8, is defined partly by the prespace on the die plate, which, in turn, is determined by the distance between the point at which the surfaces of the pressure rollers come together to pull up the die plate and the point at which the letter is first begun to be formed, i.e. the leading edge. The interletter spacing is also defined partly by the total width of the letter from the leading edge of the letter to the trailing edge of the letter. Finally, the interletter spacing is partly defined by the post spacing or the distance between the trailing edge of the letter and the point at which the surfaces of the pressure rollers no longer grip the die plate sufficiently to continue pulling the die plate and lettering tape. For any given letter on a die plate, the width of the letter is a constant Additionally, the post spacing is typically a constant A minimum amount of post spacing is preferred to ensure that the trailing edge of the letter is fully formed before the pressure rollers release the die plate and the tape Therefore, the interletter spacing can be varied by changing the prespacing, i.e. by changing the starting point at which the pressure rollers pick up the die plate and tape. As seen in FIG. 6, the prespacing can be increased by lowering the kerning adjuster so that the pressure rollers rotate further and the die plate and tape travel further between the pressure rollers before the letter is formed on the tape. This increases the interletter spacing. The prespacing can be decreased by raising the kerning adjuster with respect to the rollers so that the pressure rollers rotate less and the die plate and tape travel less between the pressure rollers before the letter is formed on the tape.

Adjustment of the prespacing to increase the prespacing is well known in the art. FIGS. 7A–7D show the results of varying the prespacing. Given the standard spacing shown in FIG. 7D, the spacing can be increased as desired by changing the prespacing, with the results shown in FIGS. 7A–7C. However, the standard spacing may still not appear to be correct, as can be seen by observing the spacing between the "W" and the "A" in FIG. 7D. The interletter spacing determined by the distance between the trailing edge of the "W" and the leading edge of the "A" is the same as that for the other letters but the optical appearance is that the spacing is greater. It is desireable to be able to decrease the apparent distance between the two letters but this was not done previously because of the post spacing always producing a residual space. This residual space produced by the post spacing could not be retrieved because that portion of the tape had already passed through the pressure rollers. However, it has been found that this post space can be retrieved and reused, so to speak, as part of the prespace of the succeeding letter by pulling back the tape after the previous letter has been formed. This process still allows the previous letter to be completely formed by maintaining the letter-forming pressure on the die plate until after the letter is completely formed. The tape is then pulled back to effectively deduct some of the post space that insulted from formation of the previous letter. In some cases, such as with the "W" and the "A", it may be desirable to remove all of the post spacing, even to the extent of having the trailing edge of the "W" overlap the leading edge of the "A". This is done by using a portion of the trailing edge of the "W" for the prespacing for the "A". As with the post spacing, prespacing is important to ensure that the leading edge of the letter being formed is formed properly. This is done by first developing the pressure between the pressure rollers before the cutting lines of the die plate are passed between the pressure rollers to begin forming the letters In the preferred embodiment, the amount by which the tape is pulled back is 0.225 inch. Then, if the standard spacing is desired between the letter just formed and the next letter, the apparatus is designed so that 0.225 inch is added to the standard prespace. This offsets the effect of the tape pull back and still provides the usual post spacing from the previous letter and the standard prespacing provided with the next letter Significantly, however, if an amount of less than 0.225 inch prespace is added to the standard prespace, a spacing of less than the standard interletter spacing results and is called negative kerning. Negative kerning may be produced if the proper dimensions are used, giving the effect shown in FIGS. 7E and 7F wherein there is a negative interletter spacing. Negative kerning can be defined as the adjustment between one letter and an adjacent letter so that they are spaced correctly, optically, to the human eye. Negative kerning can result in overlap of the trailing and leading edges of adjacent letters even though the letters may not physically touch.

If it is desired to start the succeeding letter on the lettering tape further away from the preceding letter, the kerning adjuster 42 is lowered to one of the positive numbered positions shown in FIG. 6. This places the die plate at a position even lower than the standard position and adds prespacing. As a result, the letter-forming process starts by picking up the die plate at a point on the die plate further away from the letter on the die plate. Specifically, as the pressure rollers turn, the surfaces of the pressure rollers come together and grasp the lettering tape and the die plate at a point closer to the top of the die plate, as seen in FIG. 6. Furthermore, the amount of rotation of the pressure rollers and therefore the amount of the die plate and lettering tape that must be passed between the pressure rollers before the letter begins to be formed has been increased. The letters finally form closer to the end of the rotation cycle of the pressure rollers than is the case where the kerning adjuster is closer to the pressure rollers Alternatively, if the next succeeding letter is to be formed closer to the preceding letter, the kerning adjuster may be raised to a point indicated by one of the negative numbers to decrease the prespace Therefore, even though the tape is pulled back a constant amount, the letter on the die plate is placed closer to the pressure rollers than is provided with the standard distance. As a result, the beginning of the rotation cycle of the pressure rollers picks up the die plate and lettering tape at a point closer to the letter on the die plate The letter forming process begins on the lettering tape closer to the previously formed letter than if the die plate was positioned lower with respect to the pressure rollers However, the die plate and lettering tape are continuously pulled through the pressure rollers a set amount determined by the post space after the letter is completely formed in the lettering tape. When the pressure rollers release the lettering tape and the die plate, the lettering tape is again pulled back 0.225 inch. It is significant that the tape cartridge retracts the lettering tape after each letter forming cycle. Without the retraction step, the tape would stay at its final location after release by the pressure rollers. Then, the formation of the next letter would start that much further along the lettering tape away from the previously formed letter.

With tape pullback provided through the cartridge and with adjustment of the die plate provided through the kerning adjuster, negative spacing can be provided so that the spacing between letters of the entire word appear to be more uniform. The same comments apply with respect to the letters "L" and "T". However, for adjacent letters such as "A" and "L", the spacing might be that indicated by "+1".

The cartridge described allows for negative spacing of adjacent letters to give the appearance of more uniform spacing throughout a word. Additionally, the friction interaction between the tape and the several friction elements which may be incorporated into the cartridge minimizes or prevents unraveling of the tape and the tape roll and thereby prevents wrinkling of the multilayered tape. The design also provides more uniform letter formation by maintaining sufficient tension in the tape. Furthermore, the use of a cartridge provides greater ease of use and flexibility for the lettering machine Cartridges can be interchanged without having to protect the several rolls of lettering tape from unraveling and wrinkling.

In operation, the cartridge is placed in the lettering machine as generally indicated in FIG. 1. A lead of tape extends from the dispensing slot so that the tape can be passed between the rollers and pulled through a sufficient distance to provide a lead above the rollers. A die plate is also placed between the rollers between the lettering tape and the large flatted pressure roller. The die plate rests on the kerning adjuster and in the guides 52 so that the die plate is substantially aligned with the axis 46 (FIG. 2). The machine is actuated through an actuator bar (not shown) in the cover of the machine to depress the microswitch 24 so that the motor rotates the pressure rollers. When the flatted portion 18 of the large pressure roller passes a point directly opposite the small pressure roller, the pressure rollers pick up the die plate and lettering tape and pull them between the pair of rollers. The prespace is first pulled between the rollers and then the letter-forming edges. As the letter forming edges of the die plate pass between the pressure rollers, a letter is formed in the lettering tape. Letter forming continues during rotation of the rollers until the end of the postspace is reached. At the end of the postspace, the lettering tape is pulled back by the tape via and the die plate falls back onto the kerning adjuster 42 or may be removed. As indicated in FIG. 4, the tape is then relatively slack between the pad 100 and the fourth wall 84.

The process occurring inside the tape cartridge will be described with respect to FIGS. 4 and 5. The tape initially begins a letter forming cycle in the configuration shown in FIG. 4 The roll of tape is frictionally engaged by the guide stands 68. Tension has previously been produced by pulling a leader of the lettering tape beneath pad 100. This may be done by hand or by machine. When the tape lead extending from the opening in the cartridge is released, the pad retracts the tape into the cartridge so that the tape becomes loose in the area of the cartridge between the pad and the tape roll.

When the letter forming process begins by taking up the die plate and the lettering tape, the lettering tape is pulled from the cartridge Upon pulling the tape from the cartridge, the pad 100 moves upward and the tape is guided along the bearing 118. The tape roll turns to play out the tape as required. The frictional engagement between the guide and the cardboard core of the tape roll limits movement of the tape other than as required through the pulling of the tape from the cartridge. When the post space is reached by the pressure rollers, the letter forming process is completed and the die plate and lettering tape are released. The spring forces the pad 100 backward in the race, retracting the lettering tape in the direction indicated by arrow 98. The lettering tape slides along the steel plate 94 until the pad reaches the lower end of the race.

An additional letter may be formed on the lettering tape by repeating the process or by removing the die plate and substituting another die plate and repeating the process.

It should be noted that the above are preferred configurations but others are foreseeable. The described embodiments are only considered to be preferred and illustrative of the inventive concept The scope of the invention is not to be restricted to such embodiments. Various and numerous other arrangements may be devised by one skilled in the art without departing from the spirit and scope of the invention. For example, the tape cartridge may include only a tape supply and die plate guides, tape supply and the tape pull back mechanism, tape supply and the friction engagement which keeps the tape taut and prevents unraveling or any combination of these.

What is claimed is:

1. A cartridge for dispensing tape to be lettered, the cartridge comprising:

a cartridge frame for supporting and guiding a roll of tape including means for supporting the roll by contacting an interior surface thereof;

a tape guide;

means mounted on the frame for frictionally engaging the tape, said roll support means comprising a roll guide stand fixed on the frame for frictional engagement with a core of the roll for providing frictional resistance to rotation and slipping rotation of.the roll upon application of a predetermined force to withdraw tape from the dispenser;

a head comprising a pad for frictionally engaging a strip of tape; and a race adjacent the tape guide, said race and pad having longitudinal dimensions wherein the longitudinal dimension of the race is about 0.2 inches longer than the longitudinal dimension of the pad for movement of the pad longitudinally of the race.

2. The cartridge of claim 1 wherein the frame is substantially enclosed.

3. The cartridge of claim 2 wherein the guide comprises four walls forming a rectangular aperture for the passage of the tape through said aperture.

4. The cartridge of claim 1 further comprising first and second sides and wherein the roll support means comprises a plurality of guide stands extending from the first side to the second side.

5. The cartridge of claim 1 further comprising a frame material and wherein the plurality of guide stands comprises four rods made from a material which is substantially the same as the material of the frame.

6. The cartridge of claim 1 wherein the frame comprises a roll end and a guide end, the guide end being substantially opposite the roll end and further including an arcuate tape bearing surface fixed to the frame at the guide end and extending towards the roll end.

7. The cartridge of claim 1 wherein the frame comprises a roll end and a guide end, the guide end being substantially opposite the roll end and further including means for accepting and supporting a plate adjacent the guide end.

8. The cartridge of claim 1 wherein the frame includes a side and wherein the pad faces said side.

9. The cartridge of claim 1 wherein the pad is movable in the race along a longitudinal dimension.

10. The cartridge of claim 1 further comprising an arcuate tape bearing surface adjacent the race and opposite the guide and extending away from said guide.

11. The cartridge of claim 1 comprising tape biasing means in the form of a spring having first and second ends, the first end of the spring being mounted on the housing and the second end of the spring being fixed to the pad.

12. The cartridge of claim 1 further comprising a tape baffle for substantially preventing movement of tape in more than one direction.

13. The cartridge of claim 12 further comprising a tape roll and an end of tape on a side of the tape guide opposite the roll wherein a portion of the tape is passed through the baffle.

14. The cartridge of claim 13 wherein the baffle comprises first, second and third mutually parallel walls, with the second wall between the first and third walls, the first and third walls each defining an aperture surrounding respective portions of the tape, and wherein the tape is passed over the second wall.

15. The cartridge of claim 1 further comprising a roll of tape mounted to the roll support means and including an end on the side of the tape guide opposite the roll.

16. The cartridge of claim 15 wherein the roll comprises a spool contacting the roll support means and wherein the roll support means frictionally engages the spool.

17. The cartridge of claim 15 further comprising a pad and a side and wherein a portion of the tape is sandwiched between the pad and the side.

18. The cartridge of claim 1 further comprising a tape roll mounted to the roll support means and comprising an end on a side of the tape guide opposite the roll, and further comprising a side wherein a portion of the tape is between the side and the arcuate surface.

19. A cartridge for dispensing tape to be lettered in a first direction out of the cartridge, the cartridge comprising:

a frame for supporting a roll of tape and for including means mounted on the frame for supporting the roll by contacting an interior surface thereof;

a tape guide;

means mounted on the frame for frictionally engaging the tape, said roll support means comprising a roll guide stand fixed on the frame for frictional engagement with a core of the roll to provide frictional resistance to rotation while permitting slipping rotation thereof upon the application of a predetermined force to withdraw the tape from the cartridge;

a head for frictionally engaging a strip of the tape; and biasing means comprising a spring having first and second ends, the first end of the spring being mounted on the housing and the second end being attached to the head, wherein said head is spring biased toward the housing and engages the tape against the housing, within a race having a stop at least on its inner end and wherein further the head moves under th influence of the spring a short distance along the race upon withdrawal of the tape and thereafter returns to its rest position at the stop after the tape is cut from the roll thereby retracting the cut free end of tape a short distance within the housing.

* * * * *